US009962754B2

(12) United States Patent
Hirata

(10) Patent No.: US 9,962,754 B2
(45) Date of Patent: May 8, 2018

(54) PRESSING METHOD AND PRESSING DEVICE FOR FORMING PUNCHED PIECE BY PUNCHING METAL PLATE WITH DIE AND PUNCH

(71) Applicant: TOYOTA BOSHOKU KABUSHIKI KAISHA, Aichi-ken (JP)

(72) Inventor: Kazuyuki Hirata, Toyota (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 810 days.

(21) Appl. No.: 14/546,275

(22) Filed: Nov. 18, 2014

(65) Prior Publication Data

US 2015/0135794 A1 May 21, 2015

(30) Foreign Application Priority Data

Nov. 21, 2013 (JP) ..... 2013-241155

(51) Int. Cl.
*B21D 28/16* (2006.01)
*B21D 28/00* (2006.01)
*B21D 28/14* (2006.01)

(52) U.S. Cl.
CPC ..... *B21D 28/16* (2013.01); *B21D 28/00* (2013.01); *B21D 28/14* (2013.01)

(58) Field of Classification Search
CPC ..... B21D 28/16; B21D 28/00; B21D 28/14
USPC ..... 72/329
See application file for complete search history.

(56) References Cited

U.S. PATENT DOCUMENTS 3,211,034 A * 10/1965 Andris ..... B21D 28/16 72/329
4,072,039 A * 2/1978 Nakanishi ..... B21D 22/04 72/334
7,308,814 B2 * 12/2007 Gassner ..... B21D 28/26 72/327
2009/0165525 A1 7/2009 Schlatter et al.

FOREIGN PATENT DOCUMENTS

| | | |
|---|---|---|
| CH | 665367 | 5/1988 |
| CN | 101396707 | 4/2009 |
| CN | 202715696 | 2/2013 |
| DE | 10 2012 103 167 | 10/2013 |
| JP | 56-33134 | 4/1981 |
| JP | 59-193731 | 11/1984 |

(Continued)

OTHER PUBLICATIONS

Japanese Office Action for JP App. No. 2013-241155 dated Dec. 13, 2016, along with English-language translation thereof.

(Continued)

*Primary Examiner* — David B Jones
(74) *Attorney, Agent, or Firm* — Greenblum & Bernstein, P.L.C.

(57) ABSTRACT

A punched piece is formed by punching a metal plate by a punching portion including by a die and a punch. Before the punching, a preceding process portion provided in a stage previous to the punching portion forms a projection at an inner peripheral portion of a punch area of the metal plate that faces the die. Forming the projection cancels formation of shear droop at an edge of the punched piece in forming of the punched piece by punching of the metal plate.

8 Claims, 5 Drawing Sheets

(56) References Cited

FOREIGN PATENT DOCUMENTS

| | | |
|---|---|---|
| JP | 2000-117344 | 4/2000 |
| JP | 2000-210731 | 8/2000 |
| JP | 2001-324577 | 11/2001 |
| JP | 2002-263748 | 9/2002 |

OTHER PUBLICATIONS

Chinese Office Action for CN 201410640179.7 dated Mar. 3, 2016, along with English-language translation thereof.

* cited by examiner

PRESSING METHOD AND PRESSING DEVICE FOR FORMING PUNCHED PIECE BY PUNCHING METAL PLATE WITH DIE AND PUNCH

BACKGROUND OF THE INVENTION

The present invention relates to a pressing method and a pressing device for forming a punched piece by punching a metal plate with a die and a punch.

Conventionally, as a pressing device related to this type of punching, there is a known device shown in FIGS. 6A to 6C, for example. This prior art pressing device includes a die 31 having a forming hole 311. A punch 32 is arranged to face the forming hole 311 to be able to reciprocate between the inside and the outside of the forming hole 311 in the die 31. As shown in FIGS. 6A to 6C, with a metal plate W1 placed between the die 31 and the punch 32, by punching operation of the punch 32, a punched piece W2 is formed by punching of the metal plate W1 by shear.

In this prior art pressing device, as shown in FIG. 6B, higher tensile stress acts on an inner peripheral portion of a punch area of the metal plate W1 pushed into the forming hole 311 than on other portions in forming a punched piece W2 by punching and especially at the initial stage of searing operation. In this way, as shown in FIG. 6C, when the punched piece W2 is formed by punching the metal plate W1, material at an edge of the punched piece W2 pushed into the forming hole 311 is moved by a large amount toward the outer side of the punch 32. As a result, the edge of the punched piece W2 is formed into an arcuate shape, i.e., shear droop W21 is formed. When the shear droop W21 is formed, a small protrusion, i.e., a burr W22 is formed at an edge portion of the punched piece W2 close to the punch 32. The burr W22 can be removed by grinding or the like after the punching. However, it is extremely difficult to correct the shear droop W21. If the punched piece W2 is used as a product, the function of the product may decrease due to the shear droop W21.

To cope with such a problem, there are conventionally proposed pressing methods or pressing devices as disclosed in Japanese Laid-Open Patent Publications No. 2000-117344 and No. 2000-210731, for example.

In the pressing method in Japanese Laid-Open Patent Publication No. 2000-117344, as shown with a long dashed double-short dashed line in FIG. 6A, the metal plate W1 is pressurized by a pressurizing tool 321, which has a larger outside shape than the inside shape of the forming hole 311 in the die 31, and the metal plate W1 is pushed into the forming hole 311 by a predetermined amount. In this manner, in the metal plate W1, a portion outward of the portion pushed into the forming hole 311 is reduced in thickness between the pressurizing tool 321 and the die 31. Then, as shown with the long dashed double-short dashed line in FIG. 6B, a punch 322, which has a smaller outside shape than the inside shape of the forming hole 311, shears the thin-walled portion to carry out punching.

Japanese Laid-Open Patent Publication No. 2000-117344 says that the shear droop W21 and the burr W22 are hardly formed by punching carried out in the above-described manner.

In the pressing device in Japanese Laid-Open Patent Publication No. 2000-210731, as shown in FIGS. 7A to 7C, a metal plate W1 is placed between a die 31 and a punch 32, and a punched piece W2 is formed by punching the metal plate W1. A protruding die 33 is arranged at the outer periphery of the punch 32. A hole 331, in which the punch 32 is housed to be able to reciprocate, is formed in a central portion of the protruding die 33. At a peripheral edge of the hole 331, a protrusion 332 is formed. The protruding die 33 can move in the same direction as the direction of movement of the punch 32.

Previous to forming of the punched piece W2 by punching with the die 31 and the punch 32, the protruding die 33 is moved toward the die 31 as shown in FIG. 7B. Then, by the protrusion 332 of the protruding die 33, an outer peripheral portion of a punch area of the metal plate W1 is sheared with a predetermined plate thickness remained uncut. Then, as shown in FIG. 7C, the punched piece W2 is formed by the punch 32.

In a pressing method in Japanese Laid-Open Publication No. 2000-210731, by shearing the metal plate W1 by the protrusion 332, material at an inner peripheral portion of the punch area of the metal plate W1 is restrained from moving toward the outer side of the punch 32. Japanese Laid-Open Patent Publication No. 2000-210731 says that the formation of shear droop W21 at the edge portion of the punched piece W2 is restrained by the shearing by the protrusion 332.

In Japanese Laid-Open Publication No. 2000-117344, the metal plate W1 is pressurized by the pressurizing tool 321, which has a larger outside shape than the inside shape of the forming hole 311, and is pushed into the forming hole 311. Therefore, even though the portion of the metal plate W1 outward of the portion pushed into the forming hole 311 is reduced in thickness between the pressurizing tool 321 and the die 31, the shear droop W21 is formed at the edge portion of the punched piece W2 in succeeding punching with the punch 32.

In the pressing method in Japanese Laid-Open Patent Publication No. 2000-210731, as shown in FIG. 7C, the metal plate W1 is pushed into the hole 311 by the punch 32. Therefore, although the metal plate W1 is sheared by the protrusion 332, it is impossible to restrain the formation of the shear droop W21 at the edge portion of the punched piece W2 in punching. In the pressing device in Japanese Laid-Open Patent Publication No. 2000-210731, the hole 311, in which the punch 32 is housed to be movable with respect to the protruding die 33, is formed in the central portion of the protruding die 33. Furthermore, the protrusion 332 for shearing of the punched piece W2 is formed around the hole 311. Therefore, in shearing the metal plate W1 by the protrusion 332, the protrusion 332 may become brittle and break.

SUMMARY OF THE INVENTION

Accordingly, it is an objective of the present invention to provide a pressing method and a pressing device that restrain the formation of shear droop at an edge portion of a punched piece in forming a punched piece by punching a metal plate.

To achieve the foregoing objective and in accordance with one aspect of the present invention, a pressing method is provided that includes: forming a punched piece by punching a punch area of a metal plate by using a die and a punch arranged to face the die; and, before the punching, forming a projection at an inner peripheral portion of the punch area, the inner peripheral portion facing the die.

Therefore, in the pressing method, the projection is formed in advance at the inner peripheral portion of the punch area of the metal plate. Therefore, even if tensile stress acts on the inner peripheral portion of the punch area of the metal plate to form shear droop in forming of the punched piece by punching the metal plate, formation of the shear droop is canceled by the projection at the inner peripheral portion. Therefore, it is possible to restrain the formation of the shear droop at the edge portion of the punched piece in forming of the punched piece by punching the metal plate.

To achieve the foregoing objective and in accordance with another aspect of the present invention, a pressing device is provided that includes a die and a punch arranged to face the die. The device forms a punched piece by punching a punch area of a metal plate by using the die and the punch. The device includes a preceding process portion that forms, before the punching with the die and the punch, a projection at an inner peripheral portion of the punch area of the metal plate, the inner peripheral portion facing the die.

In the pressing device, the preceding process portion for forming the projection on the metal plate is provided in a stage previous to the punching portion formed by the die and the punch and separately from the punching portion. Therefore, in the pressing device, it is unnecessary to form a hole or the like for housing the punch in a component of the preceding process portion, unlike the prior art. Therefore, it is possible to form a robust component of the preceding process portion. That is, the processing member for restraining the formation of the shear droop is formed to be robust.

With the pressing method and the pressing device, it is possible to restrain the formation of the shear droop at the edge portion of the punched piece.

DETAILED DESCRIPTION OF THE PREFERRED EMBODIMENTS

A pressing device 100 according to one embodiment will be described with reference to FIGS. 1 to 3C.

Figure 1:
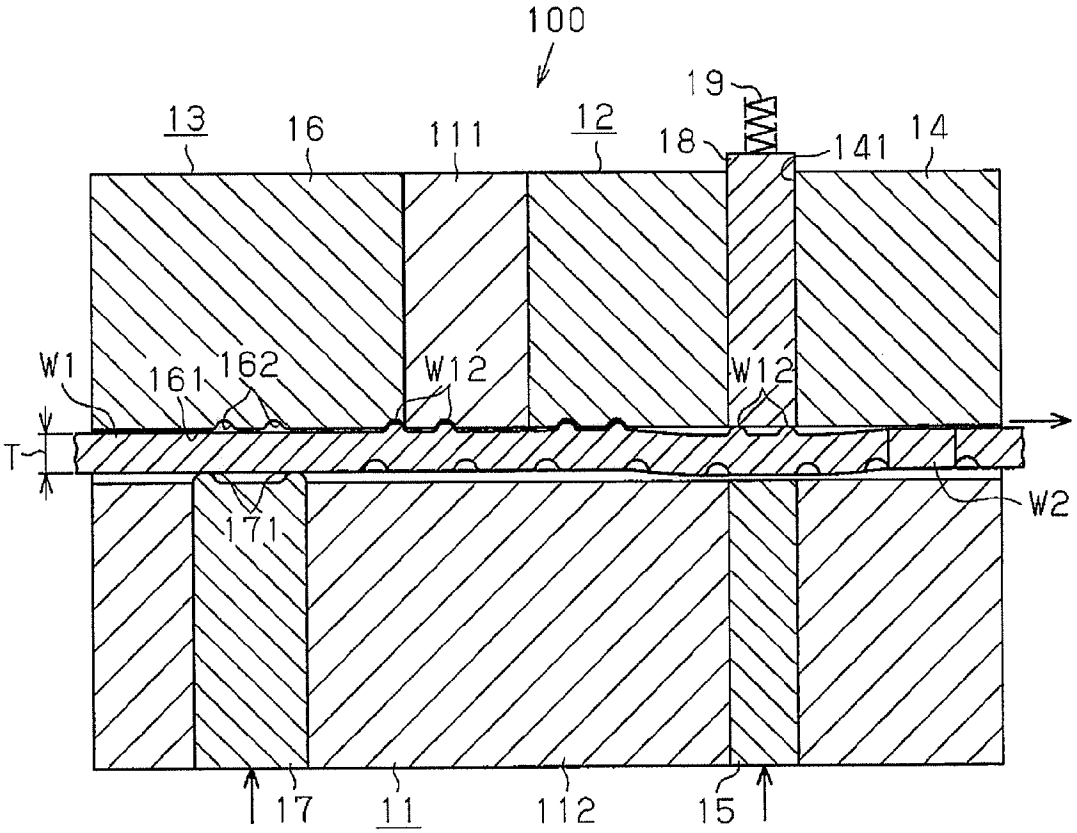
FIG. 1 is a cross-sectional view of a pressing device according to one embodiment.

As shown in FIG. 1, a device frame 11 of the pressing device 100 of the present embodiment includes an upper frame portion 111 and a lower frame portion 112, which are spaced apart from each other in the vertical direction. A sheet-shaped metal plate W1, which has a thickness T, is placed between the frame portions 111 and 112. The metal plate W1 can be intermittently transferred in its longitudinal direction (the direction of an arrow in FIG. 1). On the downstream side in the transfer direction of the metal plate W1 in the device frame 11, a punching portion 12 for forming a punched piece W2 in a shape shown in FIG. 2, for example, by punching the metal plate W1 is provided. The punched piece W2 is formed by punching and pressing at the punching portion 12. On the upstream side in the transfer direction of the metal plate W1 in the device frame 11, i.e., at a stage previous to the punching portion 12, a preceding process portion 13 for forming an annular projection W12 on the metal plate W1 prior to forming of the punched piece W2 by punching is provided. The projection W12 is formed at an inner peripheral portion of the punch area of the metal plate W1 to protrude in a direction of forming of the punched piece W2 by punching.

As shown in FIG. 1, in the punching portion 12, a punching die 14 is fixed to the upper frame portion 111 of the device frame 11. In a substantially central portion of the punching die 14, a forming hole 141 is formed. The forming hole 141 is formed to have an inner peripheral shape conforming to the outer peripheral shape of the punched piece W2 shown in FIG. 2. At the lower frame portion 112 of the device frame 11, a punch 15 is arranged to face the forming hole 141 to be able to reciprocate between the inside and the outside of the forming hole 141 of the punching die 14. The outer peripheral shape of the punch 15 is similar to the inner peripheral shape of the forming hole 141 of the punching die 14 and slightly smaller than the inner peripheral shape. With the metal plate W1 placed between the punching die 14 and the punch 15, the punch 15 carries out punching operation toward the forming hole 141 of the punching die 14, and the punch 15 enters the forming hole 141 to thereby punch the metal plate W1 to form the punched piece W2.

Figure 4:
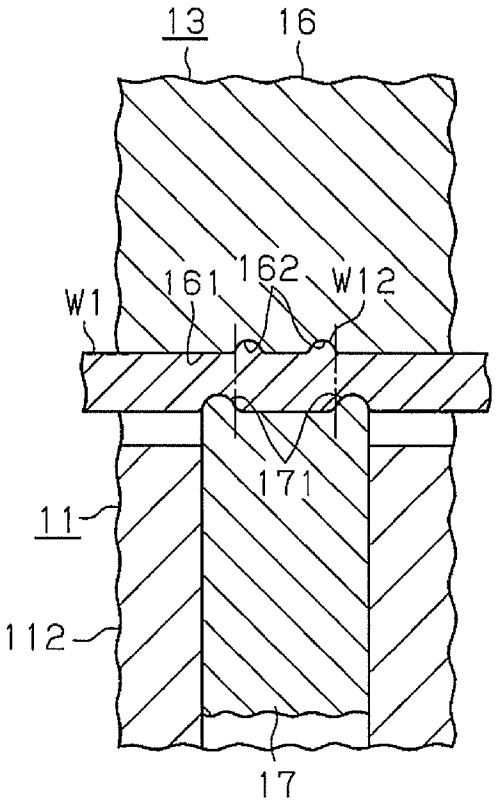
FIG. 4 is a partial cross-sectional view showing a preceding process portion of the pressing device in FIG. 1.
Figure 6A:
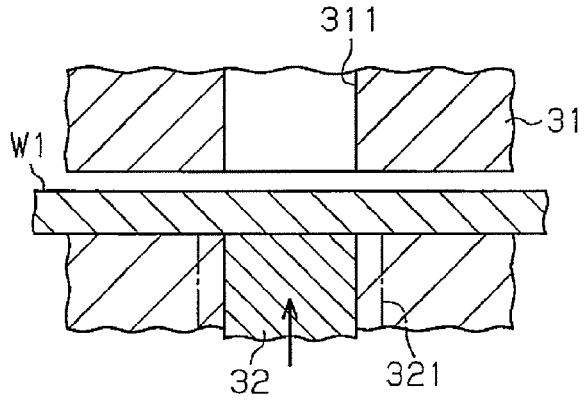
Fig.6A(Prior Art)
FIGS. 6A to 6C are partial cross-sectional views showing a pressing method of a punched piece by a prior art pressing device in order.
Figure 6B:
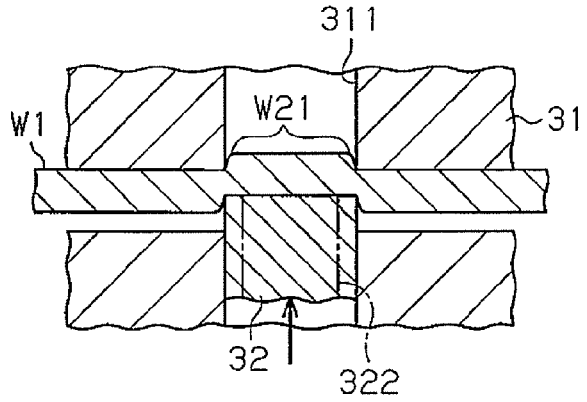
Fig.6B(Prior Art)
Figure 6C:
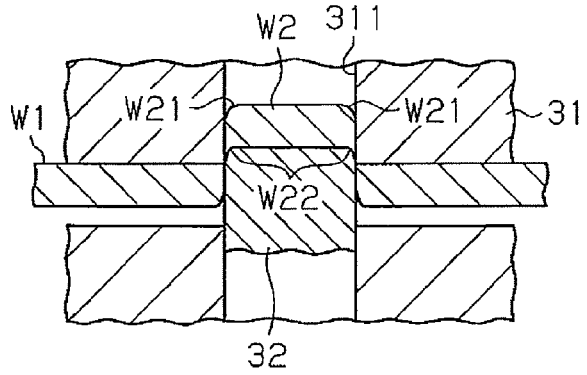
Fig.6C(Prior Art)
Figure 7A:
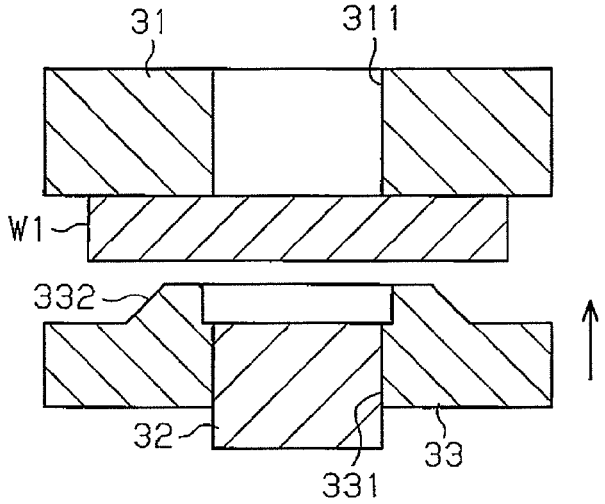
Fig.7A(Prior Art)
FIGS. 7A to 7C are partial cross-sectional views showing a pressing method of a punched piece by a prior art pressing device described in Patent Document 1 in order.
Figure 7B:
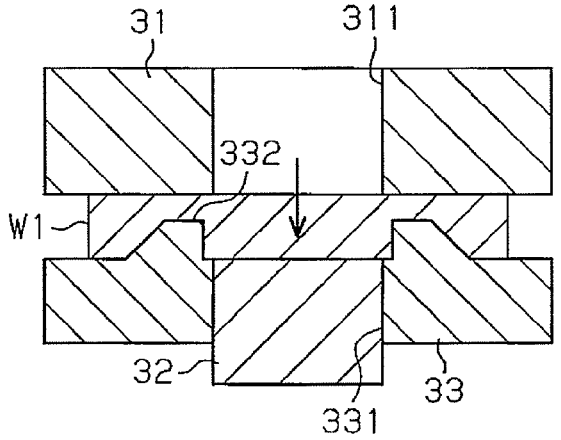
Fig.7B(Prior Art)
Figure 7C:
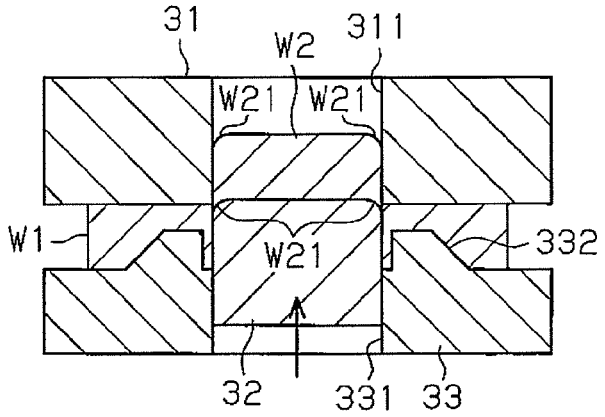
Fig.7C(Prior Art)

As shown in FIGS. 1 and 4, in the preceding process portion 13, which is located at a stage previous to the punching portion 12, a forming die 16 is fixed to the upper frame portion 111 of the device frame 11. A forming face 161 is formed on the lower face of the forming die 16. An annular recess 162 for forming the projection W12 on the metal plate W1 is formed on the forming face 161. An outer peripheral edge (a position of a long dashed short dashed line in FIG. 4) of the annular recess 162 conforms to the outer peripheral shape of the punched piece W2.

At the lower frame portion 112 of the device frame 11, a forming member 17 for pressing the metal plate W1 toward the forming face 161 of the forming die 16 is arranged to be movable in the vertical direction. The outer peripheral shape of the forming member 17 is similar to the recess 162 and larger than the shape of the outer peripheral edge of the recess 162. At the outer peripheral edge of the upper end of the forming member 17, an annular protrusion 171 is formed. As shown in FIG. 4, the inner peripheral edge of the protrusion 171 corresponds to the outer peripheral edge of the recess 162.

With the metal plate W1 placed between the forming die 16 and the forming member 17, the forming member 17 is moved toward the forming die 16 to thereby press the metal plate W1 against the forming face 161 of the forming die 16. As a result, a recessed annular area corresponding to the protrusion 171 on the forming member 17 is formed in the metal plate W1. Furthermore, on the metal plate W1, the annular projection W12 is formed at the inner peripheral portion of the punch area to face the forming die 16.

Figure 2:
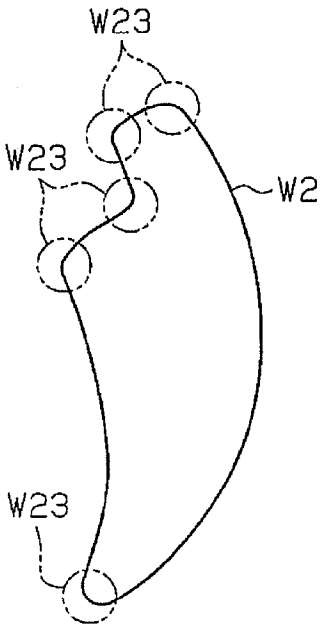
FIG. 2 is a plan view showing a punched piece formed by punching with the pressing device in FIG. 1 as an example.

Due to the outer peripheral shape of the punched piece W2, the amount of shear droop of the punched piece W2 often varies depending on the position in the edge portion of the punched piece W2. For example, as shown in FIG. 2, at encircled portions of the punched piece W2, i.e., outer portions W23 with large curvatures, the amount of movement of the material toward the outer side of the punch 15 due to punching is large and the amount of shear droop is large. In contrast, at outer portions of the punched piece W2 with small curvatures such as curved lines similar to straight lines, the amount of shear droop is small. Therefore, at the portions with larger amounts of shear droop, corresponding portions of the recess 162 of the forming die 16 are formed to be deeper to have larger volumes. Likewise, at the portions with larger amounts of shear droop, corresponding portions of the protrusion 171 of the forming member 17 are formed to be higher.

As shown in FIG. 1, in the forming hole 141 of the punching die 14 of the punching portion 12, a pushing member 18 is inserted to be movable in the vertical direction. The pushing member 18 is urged by a spring 19 toward the punch 15. When the punching die 14 and the punch 15 punch the metal plate W1 to form the punched piece W2, the pushing member 18 moves upward against the urging force of the spring 19. At the same time, the punched piece W2 comes in contact with the pushing member 18 and the projection W12 of the metal plate W1 and the bottom face of the punched piece W2 are pushed against the pushing member 18. Then, as the punch 15 moves downward, the pushing member 18 is moved downward by the urging force of the spring 19 and the punched piece W2 is returned into a punched hole formed in the metal plate W1.

Next, a pressing method for forming the punched piece W2 by pressing the metal plate W1 by using the pressing device 100 formed as described above will be described.

Figure 3A:
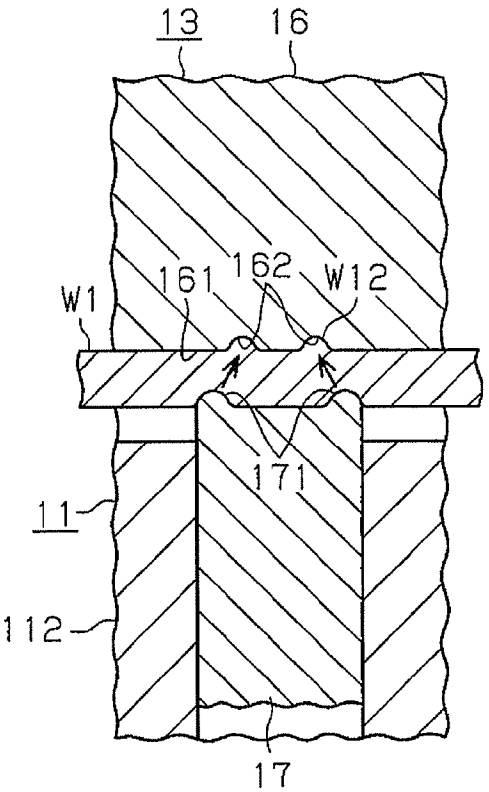
FIGS. 3A to 3C are partial cross-sectional views showing a pressing method of a punched piece by the pressing device in FIG. 1 in order.

In the pressing device, as shown in FIG. 1, the metal plate W1 is intermittently transferred in the direction of the arrow in FIG. 1 while being placed between the frame portions 111 and 112 of the device frame 11. Then, while transfer of the metal plate W1 is stopped, the forming member 17 is moved toward the forming die 16 in the preceding process portion 13 provided on the upstream side in the transfer direction of the metal plate W1 as shown in FIG. 3A. In this way, before the punching step, the metal plate W1 is pushed against the forming face 161 of the forming die 16 and the metal plate W1 moves into the recess 162 in the forming face 161. As a result, the projection W12 is formed at the inner peripheral portion of the punch area of the metal plate W1.

Then, in order to carry out the punching step, the metal plate W1 is transferred a predetermined amount to the punching portion 12 provided on the downstream side in the transfer direction of the metal plate W1. As shown in FIG. 1, the projection W12 on the metal plate W1 is arranged to correspond to the forming hole 141 of the punching die 14.

Figure 3B:
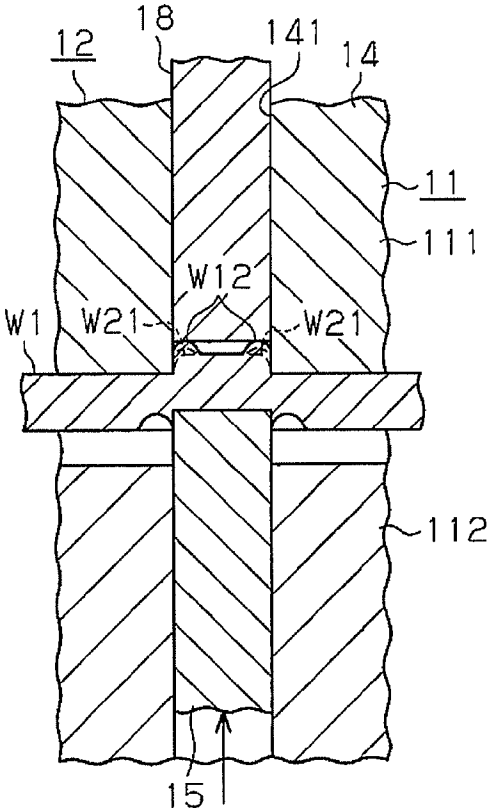

Then, as shown in FIG. 3B, the punching operation is carried out such that the punch 15 enters the forming hole 141 of the punching die 14, and the step of forming the punched piece W2 by punching the metal plate W1 is carried out. At the time of forming of the punched piece W2 by punching, large tensile stress acts on the inner peripheral portion of the punch area of the metal plate W1 that faces the pushing member 18, and the shear droop W21 may be formed. However, the projection W12 is formed in advance at the inner peripheral portion. Therefore the tensile stress acts on the projection W12 and the projection W12 cancels formation of the shear droop W21.

Figure 3C:
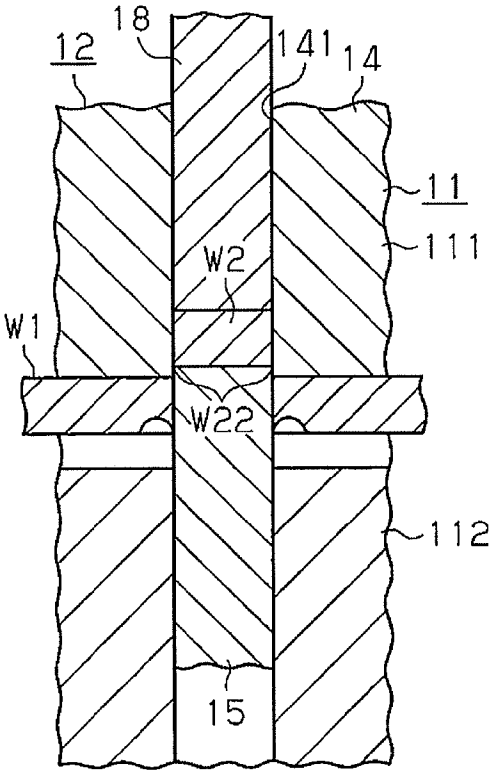

In the punching step of the punched piece W2, the punched piece W2 is pushed by the pushing member 18 against the punch 15. Therefore, even if the projection W12 remains on the metal plate W1 after canceling of formation of the shear droop W21 by the projection W12, the remaining projection W12 is flattened by the pushing member 18. As shown in FIG. 3C, the punch 15 is moved further upward to form the punched piece W2 by punching the metal plate W1 to thereby further suppress formation of the shear droop W21 at the edge portion of the punched piece W2. Even if a burr W22 is formed at an edge portion of the punched piece W2 close to the punch 15, the burr W22 can be removed and corrected after the punching.

The punched piece W2 after the punching is returned into the punching hole as the spring 19 moves the pushing member 18 toward the punch 15. Then, outside the pressing device 100, the punched piece W2 is separated from the metal plate W1 and sent to a succeeding step.

Therefore, with the pressing device 100 of the present embodiment, the following advantages are obtained.

(1) In the pressing device 100 of the present embodiment, the preceding process portion 13 is provided in a stage previous to the punching portion 12. Previous to forming of the punched piece W2 by punching of the metal plate W1 by the die 14 and the punch 15, the preceding process portion 13 forms the projection W12 at the inner peripheral portion of the punch area of the metal plate W1.

Therefore, with the pressing method, even if the tensile stress acts on the inner peripheral portion of the punch area of the metal plate W1 to form the shear droop W21 in forming of the punched piece W2 by punching the metal plate W1, formation of the shear droop W21 is canceled by the projection W12 at the inner peripheral portion. In this way, it is possible to restrain the formation of the shear droop W21 at the edge portion of the punched piece W2 in forming the punched piece W2 by punching the metal plate W1 and the high-precision punched piece W2 can be obtained.

(2) With the pressing device 100 of the present embodiment, the annular recess 162 is formed in the forming die 16 of the preceding process portion 13 for forming the projection W12 and the annular protrusion 171 is formed at the forming member 17. Therefore, the forming die 16 does not have a hole for housing the punch, i.e., the forming member 17. As a result, components of the preceding process portion 13 of the forming die 16 and the forming member 17, can be respectively formed to be robust. Moreover, the forming die 16 has a simple structure and therefore it is possible to suppress, to some extent, increase in the number of components of the pressing device 100 and complication of the structure of the pressing device 100.

(3) In forming of the punched piece W2 by punching of the metal plate W1, the projection W12 of the metal plate W1 is pushed by the pushing member 18. Therefore, if the projection W12 remains on the metal plate W1 after canceling of formation of the shear droop W21 by the projection W12 in forming of the punched piece W2 by punching, the remaining projection W12 can be flattened by the pushing member 18.

(4) The preceding process portion 13 includes the forming member 17 for pressing the metal plate W1 toward the recess 162 for forming the projection W12 on the metal plate W1. The protrusion 171 for pressing the metal plate W1 toward the recess 162 is formed on the forming member 17. By pressing the metal plate W1 against the forming face 161 with the protrusion 171 of the forming member 17, the metal plate W1 moves into the recess 162 in the forming face 161 and it is possible to properly form the projection W12 on the metal plate W1. Moreover, since the protrusion 171 is positioned outward of the punch area of the metal plate W1, a deformed portion does not remain at the punched piece W2 due to pressing by the protrusion 171, and it is possible to obtain the high-precision punched piece W2.

(5) The recess 162 in the forming die 16 is formed to be deeper at positions where large shear droop W21 is likely to be formed at the outer periphery of the punched piece W2 to increase the projecting amount of the projection W12. Therefore, it is possible to reduce variations in the effect of canceling of formation of the shear droop W21 by the projection W12 among positions in the edge portion of the punched piece W2 due to the outer peripheral shape of the punched piece W2.

Modifications

The above described embodiment may be modified as follows.

Figure 5:
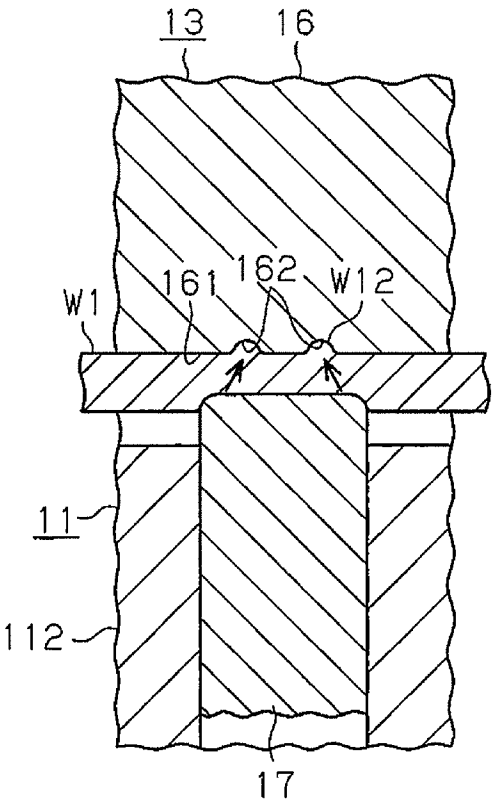
FIG. 5 is a partial cross-sectional view showing a modification.

As shown in FIG. 5, the metal plate W1 may be pushed against the recess 162 in the forming die 16 by the entire tip end of the forming member 17.

If the punched piece W2 has an outer periphery in a circular shape or the like and shear droop W21 is formed uniformly throughout the circumference, the recess 162 in the forming face 161 of the forming die 16 may be formed to have a uniform volume throughout the circumference. In this way, a projection W12 that has a uniform projecting amount is formed throughout the inner peripheral portion of the punch area on the metal plate W1.

Although the depth of the corresponding recess 162 is increased to increase the projecting amount of the projection W12 in the above embodiment, the width of the recess 162 may be increased to increase the projecting amount.

What is claimed is:

1. A pressing method comprising:

forming a punched piece by punching a punch area of a metal plate by using a die and a punch arranged to face the die; and before the punching, forming a projection on a peripheral portion of the punch area that faces the die and forming a recessed area in a portion of the metal plate that faces the punch and surrounds the punch area.

2. The pressing method according to claim 1 further comprising:

pushing the formed projection of the metal plate during the punching of the metal plate to flatten the formed projection.

3. The pressing method according to claim 1, wherein the projection is formed to have a projecting amount based on an amount of movement of the metal plate toward an outer side of the punch during the punching of the metal plate.

4. A pressing device comprising:

a preceding process portion configured to form a projection on a peripheral portion of a punch area of a metal plate and form a recessed area in a portion of the metal plate that is opposite to the projection and surrounds the punch area; and a die and a punch arranged to face the die, the die and the punch being configured to form a punched piece by punching the punch area of the metal plate, wherein the preceding process portion is provided upstream of the die and the punch in the pressing device such that during formation of the punched piece, the projection and the recessed area are formed by the preceding process portion before the punch area is punched by the die and the punch.

5. The pressing device according to claim 4, wherein the preceding process portion includes:

a forming face having a recess for forming the projection; and a forming member for pushing the metal plate toward the forming face, the forming member having a protrusion for forming the recessed area.

6. The pressing device according to claim 5, wherein the recess of the forming face has a volume based on an amount of movement of the metal plate toward an outer side of the punch during the punching of the metal plate.

7. The pressing method according to claim 1, wherein the recessed area is formed such that an inner peripheral edge of the recessed area conforms to an outer peripheral edge of the projection.

8. The pressing device according to claim 5, wherein an inner peripheral edge of the protrusion of the forming member conforms to an outer peripheral edge of the recess of the forming face.

* * * * *